US006318678B2

(12) United States Patent
Ireland

(10) Patent No.: US 6,318,678 B2
(45) Date of Patent: Nov. 20, 2001

(54) MODEL RAILROAD OCCUPANCY DETECTION EQUIPMENT

(76) Inventor: Anthony John Ireland, 97 Park Dr., Norcross, GA (US) 30071

( * ) Notice: Subject to any disclaimer, the term of this patent is extended or adjusted under 35 U.S.C. 154(b) by 0 days.

(21) Appl. No.: 09/760,329

(22) Filed: Jan. 13, 2001

Related U.S. Application Data

(62) Division of application No. 09/354,506, filed on Jul. 15, 1999, now Pat. No. 6,220,552.

(51) Int. Cl.[7] ..... B61L 25/00
(52) U.S. Cl. ..... 246/122 R
(58) Field of Search ..... 246/122 R, 124, 246/34 R, 34 A, 34 B, 61, 62, 123, 167 R, 182 R; 701/19, 20

(56) References Cited

PUBLICATIONS

Bruce Chubb—"Build Your Own Universal Computer Interface"—Book ISBN# 0–8306–3122–4 Published 1989, Tab Books, Division of McGraw Hill. In USA. pp. 223,224,235 Copied, and Book Title/Cover.

*Primary Examiner*—Mark T. Le

(57) ABSTRACT

New techniques are presented for occupancy detection methods employed in the control, automation and operation of scale Model railroad layouts that permit new types of capabilities to be incorporated into the railroad. The invention allows for a universal occupancy detector that can automatically configure itself to work on common rail or direct home wiring arrangements. This occupancy detector is able to work with large track feeder parasitic or stray capacitances and is also able to determine when any direct home track section is energized.

8 Claims, 3 Drawing Sheets

MODEL RAILROAD OCCUPANCY DETECTION EQUIPMENT

This specification is a Divisional application following on from Ser. No. 09/354,506 dated Jul. 15, 1999, now U.S. Pat. No. 6,220,552.

BACKGROUND OF THE INVENTION

This invention pertains to the field of control systems for scale model railroad layouts, and specifically to improvements in elements of block occupancy and location detection methods that are employed on model railroads.

Improvements in the miniaturization, increased capability and decreasing costs of electronics components coupled with new circuit designs have allowed the application of new techniques to model railroad layouts. These advances permit the creation of layouts with greater levels of sophistication, automation and real time feedback of operating states from many types of devices on or around the layout.

Track occupancy detection for model railroads has been used for many years. It is used for both operation of signal systems and also to display track state for areas out of direct view of the engineer or controlling dispatcher. Most practical and commercial products employ derivatives of the 1958 era Westcott "Twin T" circuit that uses back to back or bilaterally connected semiconductor diodes to develop a detection voltage when current flows through in either direction. This permits reliable detection of rolling stock that draw power for motor or other loads or have detector resistors fitted to their wheel sets. Other methods such as that of Richley, U.S. Pat. No. 5,752,677, may operate without DC power consumption and have been suggested for performing occupancy detection for model railroads. These high frequency methods are analogous to some methods used by the real prototype railroads such as the method of Stillwell in U.S. Pat. No. 5,417,388.

In the model railroad case the metal rails are used for conducting power and locomotive control signals from the track power booster to the layout and powered rolling stock. There are two different methods employed for wiring model railroad layout when using modern Digital Command Control signals driven by track power boosters. These are "Direct Home" wiring and "Common Rail" wiring. The Common rail wiring is a direct descendant of earlier common rail wired DC or AC system method and employs a two-wire approach. Today the "Direct Home" architecture is being adopted more often because it enforces a more disciplined modular wiring strategy for the layout. It also benefits model railroad wiring by allowing a single type of wiring method from a booster to any track section, irrespective of whether the track section is a "reversing section" or not. The Direct home strategy employs an implied three-wire connection to the boosters. Here the safety-ground bonding conductor is separate from the track current carrying conductors.

Employing the common "Twin T" circuit arrangement for the Direct home strategy requires careful design to ensure an optimal design solution, and hence differs from a Common rail design. It is typically difficult to use a Common Rail detection system on a Direct Home wired layout without carefully arranging the detector power supplies and detection blocks to be in a single booster power district. Additionally, when using Digital Command Control signals, the capacitive loading of an unoccupied track section tends to falsely trip the simple "Twin T" detector strategy when the track detection block is large and has long feeder conductors with significant parasitic or stray capacitance to ground.

Signaling based on block occupancy detection allows the introduction of Automatic Block Signals, ABS, or Centralized Traffic Control, CTC, or other traffic control strategies to model railroad layouts. In addition to allowing operation in the exact same manner as the prototype railroads, the model layout has another useful possibility of employing computer directed and generated traffic for both automated operation or semi-automatic operation. This is valuable since on many of the larger and more complex model layouts it is infrequent that a full roster of trained operators is available at all times, unlike the prototype railroads that are staffed 24 hrs a day for critical train movements. Thus the option of some form of computer assistance allows a greater level of realism and activity for the model railroader.

Key to employing computer automation is a method of detecting both block occupancy of a track section and also detecting and identifying the rolling stock that is actually in the block. This ensures that the computer program does not need to consider an infinite set of possible layout states, error conditions or inferred locations of rolling stock, since it can monitor the exact state of the layout at any time. Notably, operators tend to move locomotives and rolling stock around the layout after derailments or coupling breaks or other actions, in a maimer that the real railroads cannot do. The model railroader can simply pick up and move rolling stock from one location to another, creating havoc with a system that can't make a positive identification of rolling stock and its location. Practical computer enhancements need positive identification of rolling stock and its location. An alarm to indicate the addition or removal of equipment and the location of the action is a very useful detection improvement.

The capability of addressing or interrogating a particular device on the layout, detecting a predetermined coded response and then being able to determine its location is termed transponding. As for track occupancy detection, it is most common to use current conducted via the tracks to perform transponder detection. It is possible to perform the identification function with for example; Radio Frequency Identification techniques, infrared emitters, acoustic emitters and even bar codes or color coded areas detected by an optical scanner. Feedback by current is preferred since a continuous metallic circuit is conveniently available with the tracks running throughout the layout.

The acknowledgement pulses generated by a particular transponder device are defined to occur directly after, and to be time synchronized to, commands that a transponder recognizes are addressed to its attention. These pulse responses are then an "identification acknowledgement" that is prompted by the system. This directly links the detection of valid current pulses to the address of the command that has just been sent and thus allows the address of the responding transponder to be inferred. By having a number of independent transponder detectors monitoring different track sections is possible to both determine the address of a transponder on the layout and also to localize its location to a specific track section.

Zimo Electronics has commercially demonstrated pulsed current unit identification of mobile locomotives on digitally controlled and powered layouts in Austria. The method used is the generation of brief but large acknowledgement or feedback current pulses at predetermined time windows by the controlling unit, or decoder, in the locomotive. The method uses four individual current pulses for a single acknowledgement, or ACK, and these are grouped as two pulse pairs in alternate voltage cycles. The large magnitude of these current pulses, typically larger than the motor operating currents, allow for pulse detection in the presence of additional current draws of motors lights and other power usage on the layout.

This implementation of transponder technology suffers from several technical limitations. Allowing the motor driver electronics to create a brief short circuit across the applied track power generates the Zimo current feedback pulse. This allows large and detectable current pulses. It does not provide an inherently safe or well-controlled or defined maximum current, typically needed for long term reliability. As transponders or decoders are made smaller, it becomes problematic to equip then with electronics robust enough to provide for these uncontrolled high current pulses, particularly when available track currents are being increased to allow more concurrent locomotive operations on the same track section. The large currents created by this short circuit method also lead to potential radio interference problems, since the layout and tracks are unshielded and can radiate. The ACK current pulses used cause fast changing voltage fluctuations that increase radiation as the number of active transponders increase. Meeting the statutory and legal requirements around the world for interference suppression becomes burdensome with this method. The repeating high current spikes may interfere with or defeat the power management and short circuit protection logic of boosters or other power controlling devices.

SUMMARY OF INVENTION

Improvements in occupancy detector design and transponder capabilities described in this invention allow more layout control possibilities. These improvements are best employed in a single combined detection device, but may also be employed separately as required.

Smaller, less expensive and more reliable transponder or decoder electronics in locomotives require transponders with feedback current pulses with magnitudes less than typical motor current draws, but this places sensitivity and other burdens on the transponders detection devices.

Attempting to perform transponder operations at lower current levels than model locomotive motors typically draw imposes some tough detection challenges. In particular, the acknowledgement current pulses may have a magnitude as low as several hundredths of an ampere that must be detected within the total track current that may range from less than one ampere to eight or more amperes. Thus the dynamic range of the detector must allow for the detection of very small current signals impressed upon larger unrelated currents and noise.

To allow detection of small transponder currents, that is currents less than short circuit values, transponder detectors monitoring a track section need to employ high gain and sensitivity. In this situation the occurrence of extraneous cross talk signals or echoes when multiple detectors are connected to a single track power booster cause ambiguity in transponder location. Transponder detectors are not able to discriminate echoes by the magnitude of current pulses they may see, since it is not possible to accurately predict the current that any transponder or track arrangement will yield. Thus, all low-current transponder detection designs attempted before the improvements of this invention fail when used in operation on layouts. The techniques disclosed herein solve this problem.

The capability to detect feedback information coded by units on the layout permit many valuable and unique new capabilities to be created. For example, it is then possible to read state information back from rolling stock or locomotives or even devices with fixed connections to the track. It is possible to receive sound synchronization information from steam locomotives moving on the layout, so a surround sound unit can create realistic wheel synchronized chuff sounds. A function can be created that detects the placement of a new unit on the layout that is not being controlled or addressed by any user, to search for its control address and then alert the layout supervisor. This feature can also detect the removal from layout control of a controlled unit due to derailment or human intervention.

The universal occupancy detector design disclosed here capable of being employed on either Direct Home or Common Rail booster to track wiring methods and that is insensitive to load capacity is a valuable improvement to the art of model railroad block occupancy detection.

DETAILED DESCRIPTION OF INVENTION

Figure 1:
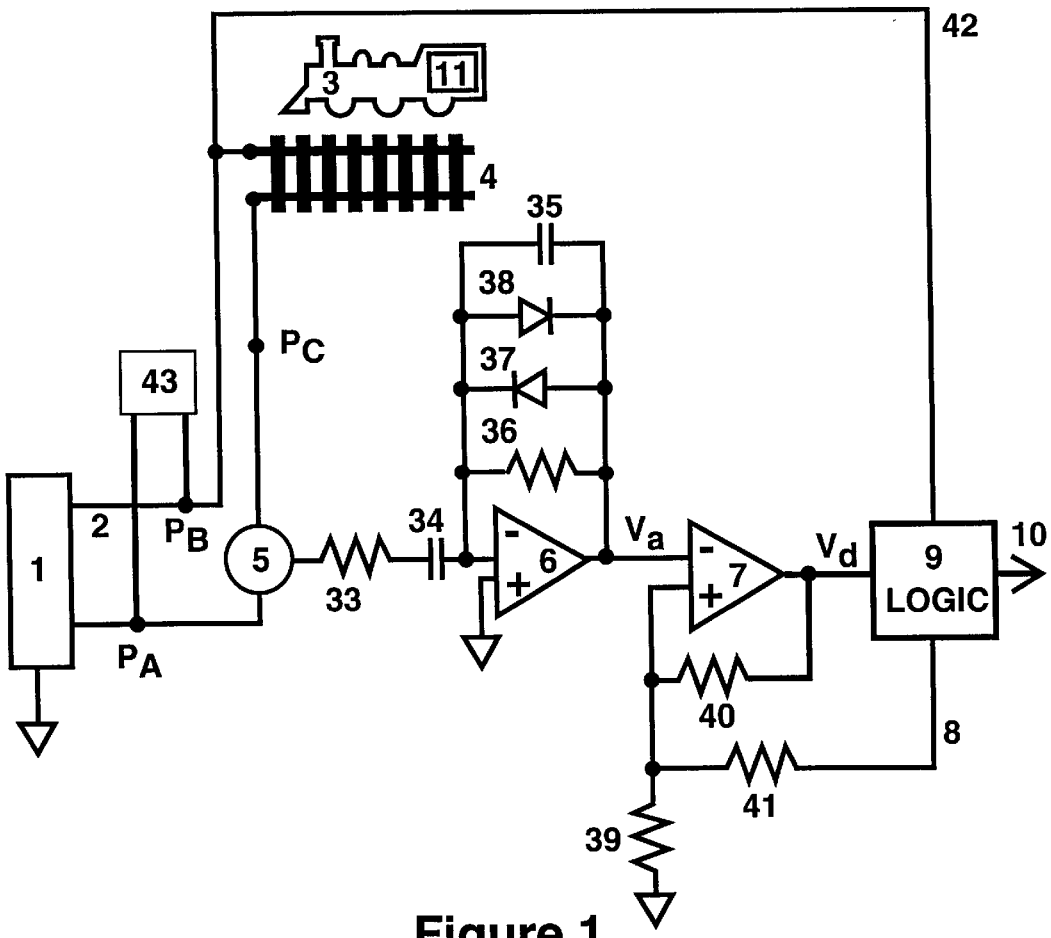
FIG. 1 details the arrangement of the electronic components that are needed to perform transponder detection functions.

The track power booster element 1 in FIG. 1, is connected to the layout tracks, 4, that are to be controlled and detected via the feeder wiring, 2. One of the feeder wires conducting power and control signals to the tracks, 4, is connected to a detection current sensor device, 5. The item we wish to detect, typically a locomotive or piece of rolling stock, 3, containing a current load and possibly a transponder device, 11, is in electrical contact with the track, 4.

Figure 6:
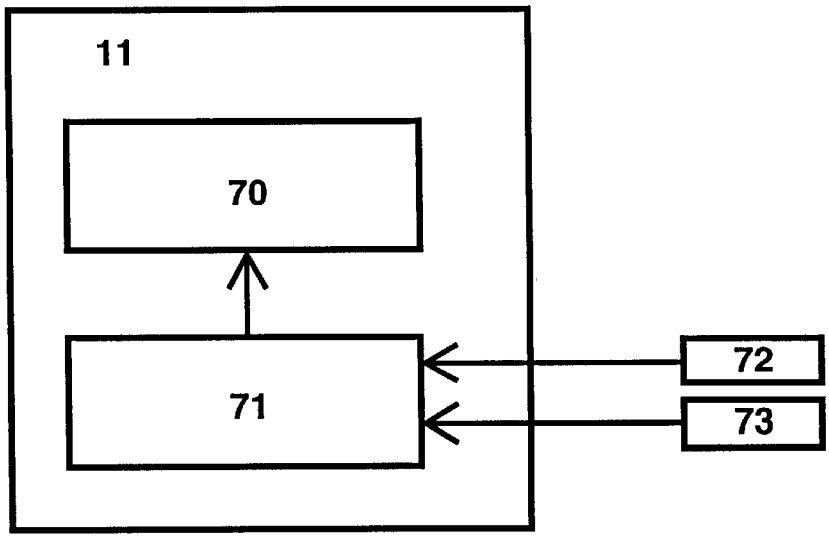
FIG. 6 is the configuration of components of a transponding device.

Transponder acknowledgement current pulses, designated in this description as Ia, are encoded and generated by transponder current generating device, 70 in FIG. 6, at appropriate time periods determined by transponder timing generator, 71 in FIG. 6, in response to system commands that are addressed to, or interrogate, the transponder. This corresponds to existing transponder techniques. The exact command encoding format used by the control system to drive the track power booster and hence the rails may correspond to any of the formats used to control model railroad layouts.

This invention follows the detection current sensor, 5, which converts track currents to voltages, with a conditioning amplifier, 6. This element amplifies the output of the detection sensor and provides any needed pulse shaping and signal filtering functions before the resulting detector voltage, designated as Va, is applied to the following decision threshold logic stage, 7. The decision threshold logic converts the time and amplitude varying detector voltage, Va, into a binary data stream, Vd, that may then be processed by the decoding logic, 9, to reconstruct the information encoded by the transponder current pulses. The detection information extracted by the decoding logic, 9, is then converted to a suitable format and then conveyed to the rest of the model railroad control system by the output connection path, item 10.

Figure 2:
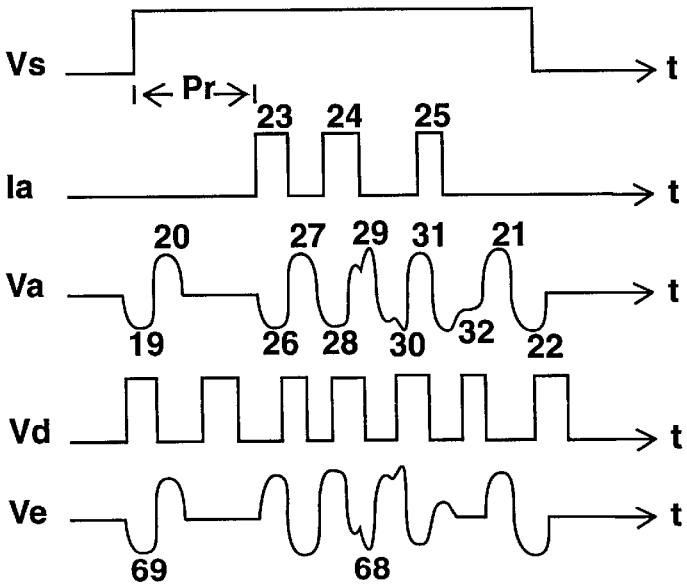
FIG. 2 displays in a time format typical wavefonns that detail aspects of the operation of the transponder detection techniques of this invention.

The preferred embodiment and the function of the elements of this invention may be understood by referring to the diagrams of FIG. 2 depicting current and voltage versus time waveforms, as often employed for presentation of electrical signals. The timing of the transponder acknowledgement current pulses, Ia, are defined to occur at predetermined times relative to the changes of track power voltage, Vs.

The track voltage waveform, Vs, shown in FIG. 2 shows a representative binary voltage waveform cycling from its low voltage state to a higher voltage state (referred to as rising edge) and then back to a low voltage state (referred to as falling edge). These voltage transitions may occur at a high frequency and many of these cycles may be sent sequentially to encode a complete command message. The actual waveform on the track might not be constrained at two distinct voltage levels. The important attribute is that an attached transponder or other decoding device and also the transponding detector may measure times between predetermined voltage levels and then infer and decode control commands from this voltage versus time waveform encoding. This allows the transponder to generate acknowledgement current pulses at a predetermined and fixed reply time after a complete command is received, and this reply time is an invariant for the particular transponding coding chosen.

Figure 3:
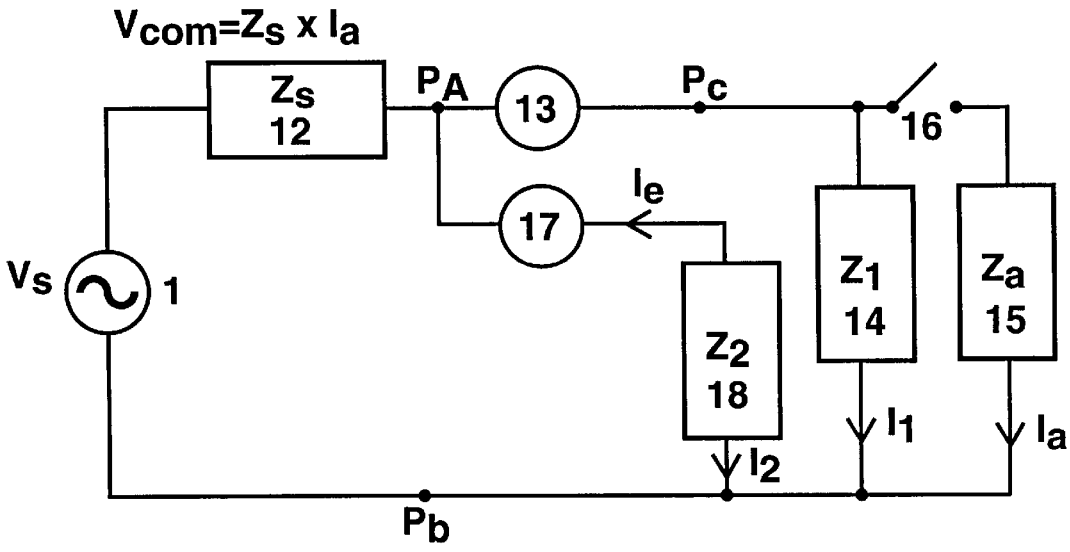
FIG. 3 details the electrical equivalent circuit of the track connections and impedance elements for a transponder connection.

A particular problem is the occurrence of cross talk or echoes between different detectors connected to the same track power booster, which can render the transponder detection inoperable. FIG. 3 represents an electrical schematic of the equivalent circuit represented by the track-connected sections of the elements of FIG. 2.

In this diagram item 11 represents the electrical equivalent of a track power booster, 1, as a voltage generator of magnitude Vs, driving the track feeders, tracks and detection sensors. The output impedance of the booster and impedance of all the common feeder wiring are combined into a single equivalent impedance, Zs, shown as item 12. This is then connected via a current sensor, item 13, to a transponder load in its track detection section represented as impedance Z1, item 14. Item 14 at a minimum, typically represents the power required for operating the transponder electronics.

Additionally, impedance Za, item 15, generates the transponder current pulses, Ia, with the closure of control switch, 16, modulated appropriately by the transponder logic circuits in the device. The transponder draws a load current I1 even when it is not generating the transponder acknowledgement currents, Ia.

The generation of the transponder current pulses, Ia, causes a voltage drop across the combined output impedance of the track power booster and the track feeder wiring, Zs, that is in common to all current sensors. The magnitude of this voltage is: $Vcom=Zs\times It$, and it acts in a manner to lower the voltage seen by all other detectors connected to the booster, 1. Since it is uneconomic to provide individual boosters to isolate every detector, the effect of this common voltage drop must be accounted for in design and operation.

If a second current detector, item 17, is connected to a separate detection track along with a high current load Z2, item 18, then this additional load current, I2, is drawn through the common booster and wiring. Inspecting the current flows and voltages it can be simply demonstrated by a person skilled in the art of circuit analysis, that current sensor 17 experiences an extra incremental current flow, Ie, which is directly related to the acknowledgement pulse, Ia, occurring through the other sensor 13. This induced echo current due to the impedances in common to both detectors is: $Ie=Ia\times(Zs/Z2)$. As the physical feeder wires are extended and the current loads in the second detector become large, the ratio (Zs/Z2) may approach the value of one. This means that a transponder current detector that does not really have a true transponder load will nevertheless falsely detect the presence of a transponder due to common impedances and voltage drops, since the echo current seen, Ie, mimics a valid transponder encoding.

The breakthrough this invention employs to circumvent this problem is in recognizing that even though a false cross-talk induced current, Ie, is generated, that upon inspection of the equivalent circuit it may be noted that the error current in all sensors other than the sensor detecting the valid transponder current will be in the opposite direction or polarity than the true generating transponder creates. If the current sensor used for detection provides information on the current direction as well as magnitude information, it is then possible to reliably discriminate a valid current pulse from an invalid or cross talk induced current pulse.

The small arrows next to the current symbols I1, I2, and Ia show the conventional current direction for a cycle when the upper lead of element 11 is positive with respect to its lower lead, and the associated load impedances draw current from the booster. This is considered the reference load current direction. This load current will reverse direction if the applied voltage, Vs, undergoes a polarity reversal, whereupon all the current directions will become opposite of those depicted. Note that the echo current, Ie, is depicted as having an opposite sense to all the other currents shown, and this corresponds to measurements made in actual physical circuits.

The method to discriminate between a valid Ia current and an invalid Ie current reduces to the ability to tell if this detection current (occurring within the expected transponder time window) is in the same or opposite direction to the reference load current direction. If the detected current is the same direction as the reference load current we know that it is a valid transponder pulse current, Ia, and not simply cross talk or an echo. If the detected current is opposite to the reference load current then we know that is simply cross talk or an echo that must be ignored.

The preferred embodiment of the invention uses high frequency current transformers to detect the track currents and convert these into voltage that are then be processed for detection. It is possible to construct many forms of current sensors that will work in this invention that measure both current magnitude and polarity (or phase) information needed to reject echoes. Hall effect sensors, magnetorestrictive sensors, resistors, complex impedances, light emitter/detector pairs and other devices known by those skilled in the art of electronic design may be employed to extract the required magnitude and phase information from the currents being sensed.

Waveforms typical for the operation of this invention are detailed in FIG. 2. A useful characteristic of transformer or inductively coupled elements used in the preferred embodiment is that the output voltage is related to the rate of change of current, or is the time differential of the applied current. This differentiation effectively provides an initial high frequency pre-emphasis ahead of the conditioning amplifier, 6. The waveform trace in FIG. 2 labeled Vs represents a partial cycle the applied track voltage from the booster, 1. If the load elements of 14 and 15 for the transponder are present and connected to the track of FIG. 1 then a waveform similar to that labeled Va will be seen from the output of the conditioning amplifier, 6. The negative voltage excursion marked item 19 is a result of the reference load current increasing in a new direction when the track voltage Vs begins its rising edge change. This current flow results from static current draws such as item 14 or any other track loads that are essentially constant during this cycle of track voltage. Immediately after the negative excursion of Va, 19, we then get a positive excursion, 20, which is related to the reference load current reaching a unchanging value when the Vs track voltage reaches the new high voltage state. At the end of the cycle we get the falling edge of Vs and the process is reversed with the initial voltage excursion, 21, being positive since the reference load current is decreasing with the lowering of the magnitude of Vs. The reference load current reverses direction and then reaches a steady state in the opposite direction, which causes the positive pulse 22. Inspection of the conditioning amplifier output pulses then allows us to correctly determine the direction of the reference current since at each change of track voltage we get a pair of indication pulses of alternating polarity that encode the new reference current direction. To alert the decoding logic, 9, to the imminent change of track voltage, Vs, we conduct a sample of Vs to the logic by synchronizing connection, 42. This synchronizing sample allows the logic to be alerted to the expected time location of the reference load current polarity indicating pulse pairs. This allows rejection or lockout of polarity determination for any voltage pulses or noise that do not occur at the correct time, and serves to improve detection reliability. Additionally the decoding logic, 9, uses the information conducted by the synchronizing connection, 42, to perform the simultaneous command and address decoding needed to locate the predetermined time period that transponder acknowledgement pulses must occur within to be considered valid. This address and command determination is also needed for complete transponder address identification.

It is possible to determine the reference load current direction without resorting to the synchronization connection, 42, but the algorithm to identify and lock onto the pulse pairs is much more complex and more prone to noise induced errors.

With the ability to identify the reference load current direction, comes the need to establish the polarity of the transponder current pulses that need to be compared with this reference direction. The effect of magnetic path saturation at high load currents of lowering signal levels and causing pulse deletions, and the presence of possible extraneous noise pulses means that it is not sufficient to simply assume that the detector voltages, Va, occurring in the transponder current time windows may be directly measured for polarity and hence current direction. Additionally there is a small timing uncertainty in the exact location of any expected current or voltage change that may be attributed to transponding. This is due to cumulative sampling time uncertainties, or jitter, in both the transponder generator and also in the transponder current detector logic. To deal with these problems of acquiring the correct direction of the transponder current pulses it is useful to create a transponder current encoding that generates an asymmetric voltage waveform in the transponder detector. The waveform is designed to provide a unique signature that may be recognized and synchronized to in time, and that generates an unambiguous pattern that will robustly encode the direction or phase information. There are a number of possible types of waveforms, each optimized for a particular current sensor's characteristics.

A current pulse waveform suitable for this invention is depicted as Ia in FIG. 2. This wave trace in time shows three time periods when the transponder current is switched on, 23, 24 and 25. The current pulse on time duration for the first pulse, 23, is chosen to be four microseconds, and the on durations for pulses 24 and 25 are six microseconds and three microseconds respectively. The first pulse, 23, is timed to start at the systems' predetermined reply time period of, Pr, of twenty microseconds after the track voltage change of Vs, as seen at the transponder. Note that the period Pr defines the start of the transponder current pulse or "ACK" window, and that this is related to a precise time after a command has been received, and is relative to a change of track voltage levels in either direction and not the polarity of the track voltage transition seen.

A current off period of three microseconds follows the on pulse 23. This is chosen so the current's fundamental pulse repetition frequency, for a total seven microsecond period, is less than the 150-kilohertz regulatory electromagnetic emission limits. The start edge of pulse 23 induces a negative output pulse in conditioning amplifier output voltage, Va, item 26. The pulse 26 on Va shows a sinusoidal nature due to the combined frequency response of the current sensor transformer and that of the conditioning amplifier, 6. It is most beneficial to tune the inductance of the current sensor transformer secondary winding with a capacitor to create a resonant tank circuit. This allows some filtering of phase jitter and broadband noise. The quality factor of the resonant tank circuit is chosen to be low enough so the output decays rapidly after a single pulse and does not ring. There are slight delays from the current pulse transitions of Ia from on-off and off-on to the change of the output voltage, Va. This is the impulse or time domain response of the current transformer and amplifier combined, and needs to be allowed for in the overall design.

When the current pulse 23 transitions to off after four microseconds it induces a positive voltage pulse 27, that nearly coincides with and reinforces the sinusoidal return of 26 to its equalizing positive swing. (The equalization of voltage pulses in a transformer is the result of the fact that the volt-time integrals of the secondary coil voltage must sum to zero when no direct current can flow from primary to secondary).

The on time of the six microsecond pulse 24 coincides with the reverse voltage swing of 27, to form negative pulse 28. The duration of 24 chosen to be long enough such that it interferes with the natural resonant swing of 28 that leads into pulse 29. The off transition of 24 occurs later than when the natural swing of pulse 29 tends negative, such that the pulse 29 trends positive again and becomes extended in time with a recognizably long duration. The effect of the 24 pulse off can be seen as a noticeable time or phase discontinuity in the form of pulse 29 such that it is not sinusoidal but has two peaks in the positive excursion shown. The modified and delayed transition of pulse 29 continues into pulse 30. At this point, the current on transition of pulse 25, six microseconds after 24 going off, acts to extend pulse 30 with the same form of discontinuity as pulse 29. The end of pulse 25 after three microseconds yields pulse 31 and since no further current changes occur in this transponder ACK timing window, pulse 31 decays via pulse 32 to return to the baseline voltage level of Va.

The positive swing of pulse 21 a little later is due to the transponder load current and its polarity is indicative that the reference current polarity has reversed for the following cycle.

The three encoded Ia current pulses in the pattern of 23,24 and 25 are considered together as a single transponder acknowledgement burst, termed an ACK pulse. The voltage waveform received in the transponding detector resulting from this ACK burst is the voltage pulse train of 26 through 32. This train of pulses is very distinctive and allows for accurate decoding of the transponder current pulse direction. The longer duration of the two consecutive pulses 29 and 30 allow for several standard methods to interpret this waveform.

Note that the positive pulse 29 happens to be of an opposite voltage to the negative voltage of the first reference current pulse for this cycle, 19. Identifying the location and polarity of voltage pulse 29 and comparing it to the expected reference voltage polarity, and hence direction, will allow us to identify valid ACK transponder current bursts or acknowledgements. That is, impulse 19 and 29 are of opposite polarity then the transponder waveform is correct and may be accepted. If pulse polarity of pulse 29 is the same polarity as 19 then the detected voltage pulses are an invalid echo and should be rejected.

By inspecting the polarity of pulse 30 we can perform an equivalent discrimination, by noting 30 is the same polarity as 19 to make an affirmative, good ACK, decision. It is preferred to use the pulse 29 to determine the polarity of the transponder current pulses, ACK. Any of the other pulses in the transponder time window could be used, but pulse 29 is the first detected pulse of a longer duration than the current-step natural pulse-response period of the system, that we would expect out of the conditioning amplifier during the transponder ACK time window. In practice the most reliable detection method checks that both pulse 29 and 30 are present as longer back to back pulses of opposite polarity. The time duration of pulse 29 and 30 summed is fairly constant over track load current ranges and the actual magnitude of the transponder current used for Ia. The magnitude used for Ia may be allowed to differ, as convenient, over a large range, with a typical lower limit of about ten to twenty milliamperes, up to a range of several amperes or more. The non linear clamping diodes, 37 and 38, in the conditioning amplifier, 6, provide a compressed output range for Va that keeps ACK pulses over widely differing current values constrained to a limited range of voltage.

In this preferred embodiment with the ACK generated as described, the periods of pulse 29 and 30 sum to a measured time in the approximate range of eleven to twelve microseconds. All the other pulses tend to be in the range of three to four microseconds, so can easily be distinguished from pulses 29 and 30 of about six microseconds. The design of the ACK pulse train timing intentionally accentuated the contrast between the shorter three-microsecond width of pulse 28 and the wider six microseconds of pulse 29, after both have been amplified and converted to a binary data stream. This provides a strong timing measurement contrast that allows an easy determination of the most probable location of the pulses 28 and 29.

With high load currents in the current sensor transformer (when running many engines on the attached track) the pulses 26 and 27 may be highly distorted or deleted due to the changing transfer characteristics of most practical magnetic core materials that can be used for current sensor construction. For this reason, these leading pulses are not the best choice for ACK polarity determination. The pulse 26 is in the same direction as the reference load current pulse 19, since it results from current starting to flow in the same direction as the transponder load current, but is a very poor choice for detection decisions. These early pulses may be used to alert the timing logic that an ACK pulse is occurring and start a search for the following long pulse 29 and 30 pulses. The transitions of these early pulses provide an approximate time reference or phase sample to lock on to prior to the accurate determination of the pulses 29 and 30. It is not possible to simply look at the pulse polarity of the ACK stream at a predetermined time since the ACK waveforms typically detected may jitter over as many as three or four microseconds, which can lead to voltage pulses being completely missed. For reliability the detection method needs to phase lock to the actual pulse stream as received, to allow accurate time measurements of pulses. Using synchronizing link 42 does not allow enough accuracy to exactly time pulse detection, but provides a coarse value of timing or alert to start searching for pulse 26.

If pulses 26, 27, 28, 29 and 30 closely meet the ACK timing criteria individually and as a group then it is generally not necessary to measure pulses 31 and 32. Note that it is possible to have no pulses in the transponder time window, and so it is reasonable to decide that ACK is not present if no pulses 26 or 27 are seen within about ten microseconds after the start of the expected ACK time window. It is also possible to count the number of signal transitions seen during the ACK time window to provide detection cross-check but that is not as powerful as measuring each pulse.

The design of an ACK pulse that can efficiently make use of the benefits of this invention follow the broad analysis presented here and may be different to this preferred embodiment yet maintain the essence of the methods of the invention. The actual circuit implementation used should be adjusted so as to create pulses that are optimal for detection reliability. Using fewer than three current pulses in the ACK yields a detection waveform with fewer uniquely detectable timing elements than the waveform presented here. Slight time changes of the ACK pulse on times or off time spacing will modify the detection waveform, and the ACK waveform presented here is a compromise between current sensor response, minimum duration of a track voltage cycles and sensitivity to the operating environment. For example, if the 25 pulse is delayed so the 30 cycle is a short pulse, then the ACK waveform can be designed to have only a single wide pulse at 29. In a phase modulation and demodulation system, these wider pulses appear as a phase reversal from the carrier phase and are very detectable.

An interesting variation is having the acknowledgement pulses 23, 24 and 25 created with multiple step levels of currents so they encode more than one possible current level. It is then possible to have a multiplicity of current increment steps and a multiplicity of current decrement steps within each component current pulse of an ACK. This allows a more precise control of detector voltage polarity transitions by allowing both varying of the pulse times to control the phasing of Va voltage pulses, and the fact that we can now add voltage control of either polarity at any point we need. This is because with a simple bi-valued current (Ia) pulse, after the current is stepped down by being switched off (leading to a positive Va pulse in FIG. 2), we have no ability generate another step down of current. This second downward step of current would allow another positive excursion to extend the total positive voltage pulse time. A second step down of current at this off time is not possible because any decrement of current would have to make the Ia pulse of a negative value (less than zero), which is not possible without complexity of an extra negative voltage supply in the transponder. An intermediate set of steps allows precise control of the Va detection waveform by controlling the placement of negative and positive voltages not being constrained that an current ON transition can only be followed by a current OFF event. It is possible to transition the full current range is a single step, not using intermediate steps, and then use intermediate steps on the opposite current change, or any combination. Non-linear gain in the conditioning amplifier tends to keep the output steps compressed irrespective of current pulse magnitude. This current step combination is chosen to give an optimal detection waveform.

For completeness, a sample of a typical erroneous voltage waveform, Ve, from an echo is also shown in FIG. 2. The reference load current direction is shown as the same as for the good ACK waveform, Va. It starts with a negative voltage pulse, 69, confirming or defining the reference load current direction. The voltage pulses during the ACK time window are the opposite of a correct transponder ACK response. The first wide pulse of the series is 68 and is in the same negative polarity as the reference. This allows this part of the waveform occurring during the ACK time window to be accurately identified as an echo waveform.

The waveforms of FIG. 2 are shown for an ACK pulse that occurs while the track voltage, Vs, is in its cycle of highest or positive value, after its rising edge. It is just as likely that an ACK pulse may occur during the lower value, or negative voltage cycle part of the Vs waveforn. If this is the case, the waveform timings of Ia, Va, Vd and Ve are all reversed in polarity as from those shown in FIG. 2. The rules and methods described for ACK pulse detection are unchanged for either cycle of track voltage and current.

The single ACK waveform structure (composed of multiple interrelated pulses) shown here is defined to occur within a predefined transponder time window from a track voltage transition, after an interrogating command addressed to the transponder is received. This simple form of ACK just indicates that the transponder is present and confirms its address or identity. In fact, this ACK is the first ACK seen after the command is completed and hence is special. It would be proper to identify its special properties used in practice to date, by terming it as an identifying acknowledgment or ID_ACK.

It is advantageous to expand this simple ID_ACK concept by repeating the ACK pattern in several consecutive track voltage cycles after the first ACK is expected. An example of this is documented by the National Model Railroad Association, in a proposed Technical Note TN-9.2.1 of June 1998. Here they define four ACK bursts or bits, each of the cycle timing of the singly employed Zimo ACK pulse, described earlier. After these four ACK bursts at the end of a new command or packet, the track voltage timing is then defined as being associated with "restricted speed instruction encoding", that is clearly not related to transponder information readback functions. The first ACK is sufficient to provide ID_ACK, as is the case with the Zimo implementation, and a further three allows encoding of other meanings.

Providing a grouped multiplicity of redundant ACK pulses that are intended to be interpreted solely as an ID_ACK, exceeding the minimum required single ACK pulse, allows another novel possibility. For example, if the ID_ACK is defined as the detection of any one of the first four possible ACK pulses to a new transponder address or interrogation, this allows the detection electronics to time-share, multiplex or monitor up to four current sensors.

This allows a significant cost reduction per transponder detector, since the electronics are a significant contribution to the device cost. Now the transponder generates an ID_ACK of four consecutive ACK pulses The detection electronics sequences through each of the four sensors during the four ACK pulses that are now sent as a simple acknowledgement or ID_ACK. If a single ACK is seen on a sensor it can be accepted as one of four possible transponder responses to that interrogation and confirms the location and identity of the transponder as in normal transponder practice.

After the four ACK windows reserved for ID_ACK, the sensor that detected a good ID_ACK is then monitored for further possible encoded transponder information in the form of further ACK pulses. These can occur after the initial four ACK pulses now defined as available for simple transponder acknowledgement.

Any following ACK pulses are not needed to locate the transponder, and can occur on each track voltage cycle up to the completion of reception of the next command, which then starts another transponder interrogation cycle.

This allows the encoding of many types of useful information from the transponder back to the transponder detector and hence to the layout control system. Note that a multiplicity of ACK pulses may be chosen to expand this simple ID_ACK, not just the four as mentioned here. A singularity of non-redundant ACK pulses to perform the ID_ACK function is the limit of prior designs, such as the Zimo product.

The analog pulse output, Va, of the conditioning amplifier 6, as described so far is not in a format that is readily interpreted by the preferred decoding logic means, 9, which is a fully digital detection method in the preferred embodiment. The voltage Va needs to be converted to a binary data stream by the decision threshold logic, 7, so that the logic and algoritluns employed by element 9 can measure the pulse periods and sequences and hence decode ACK events.

In the preferred embodiment a voltage comparator with hysteresis is used to perform a binary decision threshold on the waveform Va. This produces the comparator output digital waveform, Vd, shown in FIG. 2. The resistors 39 and 40 introduce the correct amount of hysteresis. The resistor 41 driven by a tri-state digital logic control line from the decoding logic, 9, is a possible implementation of initializing link, 8. The hysteresis range sets the sensitivity of the system, and if it is too sensitive, amplifier noise will produce excessive false pulses. Note that since the comparator is in an inverting configuration to generate hysteresis, the comparator output goes low when a positive excursion of Va exceeds the positive threshold and goes high when Va goes below the negative hysteresis threshold.

The comparator used to implement the decision or data detection item 7 in the preferred embodiment only produces a binary or two level output. If we wish to automatically measure the reference load current direction we have to discriminate the digital data waveform, Vd, at the transitions of track voltage Vs. A negative pulse on Va produces a positive pulse or high level on the comparator output and vice-versa for a positive Va pulse. The provision of hysteresis means the comparator has a memory of its last output when input signals are less than those required triggering a change of Output State. To determine reference track current direction we need to find the voltage transition between pulses 19 and 20 on Va, and then infer the direction from the new state of the comparator. An added complexity is that the timing of 19 and 20 both can vary widely with the track current and voltage transition rate of the Vs waveform generated by the booster. The end of pulse 20 is not easily found since at low currents there is not enough of a negative ring from the end of pulse 20 to trip the comparator and mark the completion of positive pulse 20. Additionally the timing of track transition of Vs to the leading pulses 19 or 21 may have jitter and we cannot be certain state of the comparator at the end of the last track voltage cycle.

To overcome these detection problems, it is useful to perform two consecutive timing measurements on consecutive transitions of Vs in the same direction. This provides a stable reference and removes errors when sensing on edges with opposite transitions. To ensure correct initial states for the comparator we employ an initializing link, 8, to alternately set and reset the comparator output state to a known level. This link is employed before the earliest possible emergence of a leading edge pulse, 19 or 21, when the voltage of Va has returned to its resting state less than the comparator input change threshold voltages. Link 8 operates by perturbing the hysteresis level with the required change needed to force the comparator output to the desired state. This connection is implemented in any manner to give at least three possible actions; no modification of comparator output state, initialize the comparator output state to low, and initialize the comparator output state to high.

The sequence of events is, for example, to initialize the comparator output, Vd, initially low before pulse 19 can occur at the rising edge of Vs. We then wait for, and start timing reference time, T1, from the transition of Vs going positive. A negative pulse 19 will then set the comparator output high and then a positive pulse 20 will then force Vd low again as a falling edge. This time, T1, for this falling edge change of Vd identifies the end of a negative initial pulse 19 and the beginning of 20.

We wait for the negative cycle value of Vs to start and then we now set the comparator before the next rising edge of Vs would lead to a repetition of another negative pulse, like 19. We now time a second period, T2, from the Vs rising edge to a possible rising edge of Vd at the end of the following positive voltage pulse. We employ a timer maximum value to ensure that if we see no rising edge that we do not wait for an excessive time. In no case can T2 be any shorter than the width of both the negative and then positive pulses. T1 cannot be any longer than the initial negative pulse of 19. In this case, if the voltage waveform is as shown, we will get T1 less than T2 indicating a reference load current direction with a leading negative pulse for a rising edge of Vs.

For either initialized Vd state, we time the period elapsed to return to the same Vd state after the Vs transition occurs.

If the reference load current pulse, 19, is initially positive, for a load current reference direction opposite of that just measured, we find that measuring T1, looking for a negative edge from the comparator being made low before pulse 19, will yield period at least as long as both pulses 19 and 20 or a maximum timeout limit. Performing the T2 measurement, after initializing the comparator set high on the next following positive edge of Vs, we will get a positive edge measurement of Vd that is the just the width the leading positive pulse. Here we know that if T1 is greater than T2 we have a reference load current direction that gives a leading positive pulse for a rising edge of Vs. This is a differential time measurement and allows us to accurately infer the polarity sequence of 19 and 20, only relying on sufficient signal to detect both 19 and 20.

If we perform the same measurement of direction with the track transition Vs falling, instead of rising as shown in FIG. 2, we will find the Va and Vd waveforms with opposite polarity. Here for a following valid ACK pulse, phase or time locked to the falling edge of Vs, we will get period T1 greater than T2, and thus we know the initial load current reference pulse of Va is now positive and so it follows a pulse 29 must be negative (opposite the reference) for a good ACK.

The absolute direction of the reference load current is of no concern, and it alternates on each polarity of the track voltage. This automated time measuring technique yields the polarity of the initial load current pulses with respect to change of Vs in one direction. Knowing this voltage polarity immediately tells us what polarities each pulse of a good ACK pulse stream should be. That is, if pulse 19 is negative, as shown by T1 period being less than T2 then we need the pulse 26 also to be negative, or the pulse 29 to be positive (opposite the reference) for a good ACK waveform.

This measurement method allows the invention's key concept of echo discrimination to be performed by solely inspecting and timing the output, Vd, of the decision threshold logic, 7. No other assumptions need to be made.

The detection means, 9, to analyze the Va or Vd waveform and detect echoes may be created straightforwardly by those skilled in the art of digital circuit design and analog and digital signal processing techniques, by using the rules for interpreting the important pulse properties that have been discussed here. A preferred approach is to employ software timing, analysis and decoding techniques that are implemented in a high-speed microprocessor or digital signal processor. This allows a flexible design and lowest hardware costs. In particular the detection algorithm is triggered by transitions of Vs conducted by link 42. The software then executes fast timing loops or in-line high-speed input sampling code sequences that can measure the timing of digital pulses, Vd, by detecting the changes in its voltage state. These timing measurements are then reviewed by a software algorithm that is designed to recognize allowable pulse timings and reject pulse timings and sequences that are invalid. Other software that executes in the processor also decodes the commands encoded by the track voltage waveform and determines where transponder time windows are expected.

A further software module combines this information to infer from measurement results what type of response needs to then be sent to the rest of the control system over link 10. It is possible to perform the pulse time measurements with analog time discrimination techniques, external pulse measuring devices or even timing capture units that may be integrated in the processor. These non-software approaches are augmentations that may simplify the burdens placed on the system software. For example it is possible to use phase-lock techniques, like those used for the recovery of the color reference burst used in color TV waveforms. A following synchronous detector can then easily detect the intentional phase transitions encoded by the ACK pulse format described in this invention. The information output to the rest of the system, 10, may be designed and configured in any manner to meet the connection and information distribution method chosen for the rest of the layout control system components.

Any un-synchronized current transitions that occur at random times during a track power voltage cycle may inject spurious noise pulses into the output of the conditioning amplifier. These noise voltage pulses occur with a lower rate than the expected pulses, but must be guarded against by the appropriate design of the detection algorithms that process the current pulse information. For example; it is possible to have simple tests to ensure valid pulses are of an expected duration, and only process pulses that occur within explicit time windows and ignore other that are outside the correct time windows. Since track commands and addresses are continually repeated or refreshed to the track it is possible to used a weighted average of detection events to make the final detection decisions to be output to the rest of the control system by connection 10, thus lessening the effect of spurious noise. The determination of the reference current direction can occur on every track voltage cycle and so is easily averaged and weighted to provide an error free direction or polarity decision.

It is important to note that only the relative relationship of direction of the transponder current pulses, Ia, to the reference current direction, I1, during the transponder current time window need to be considered for this invention. This relationship is fixed by the fact that the current loads Z1 and Za are connected to exactly the same circuit and are fixed when the transponder device is installed in the rolling stock or even when a fixed transponder is connected to the layout. If a track connection is reversed by reversing the track placement of rolling stock, or a current sensor connection is reversed, the relationship of these currents to one another remains the same although both will then be reversed in polarity. The decoding logic, 9, interpreting the sensor information simply takes account of this fact. If the transponder pulse generator also includes the decoded control of other loads such as motors and lights it is good practice and straightforward to arrange for all current changes to these controlled items to be made outside of the transponder current detection time windows. Excessively noisy devices such as DC motors with badly adjusted brushes may be improved by utilizing standard noise and filtering techniques. Statistically, these noise sources can generate a series of pulses, but the time detection windows of the detectors reject all the noise that falls outside the allowed times.

The 1993 introduction of the Autoreverse™ feature for model railroad layouts by Digitrax Inc. creates a situation that the transponder detector logic, 9, must consider. If an autoreverse decision and reversal action occurs in the track section between the polarity current pulses at the start of a track voltage cycle and the transponder current pulses, Ia, then the normal relationship between these two currents will be reversed for just that track cycle. Accordingly, the discrimination of valid and echo currents will be briefly upset. The control logic can simply average detection events and then can reject isolated occurrences that are due to autoreverse events. The filtering of detection events is employed at all stages of a prudent detector design.

A simplified implementation of this invention may be created where the installer of the current sensors manually presets the reference current direction for each sensor to a standard value. In this manner the electronics will not need to measure and automatically decide the reference current direction by interpreting the current pulses seen by the current sensors. It will maintain the reference current direction as fixed relative to the state of the track voltage, Vs, polarity defined in the transponder pulse time window at installation time. The electronics and control logic will still discriminate echoes by the method of comparing the transponder current pulse direction to this preset reference current direction as the preferred embodiment of this invention does.

This method works with track command voltage encoding methods and decoders that detect the transponder current pulse time solely by timing the changes of track voltages and not the absolute track voltage polarity, or if the locomotive always physically picks up the same track polarity independent of track orientation. An example of the latter is locomotives that pick up track current via a central track pickup shoe underneath or overhead wire pickup, which both maintain a constant track feed polarity.

On systems meeting either of these criteria, if a locomotive with a transponder is reversed in its placement orientation on the track it will still calculate the same exact transponder current pulse time window.

With a timed pulse track command encoding, even though the track voltage seen by the locomotive is now reversed in polarity, the transponder time window is still fixed in time relative to the command. The reference load current and transponder currents are both in the same direction, and are now reversed locally in the locomotive. These current directions will appear unchanged to the current sensor since the time of the transponder pulses and the polarity of Vs conducted to the detector logic via the synchronizing link 42 are unchanged. If the locomotive always picks up the same track polarity then the current sensor will never see a changed reference current direction in the track section it is monitoring.

If the polarity of the track voltage Vs feeding into the current sensor is reversed, or the current sensor leads are swapped, then the reference current direction for that current sensor relative to the polarity of Vs will be reversed.

At installation it is possible to setup the reference current direction by simply placing a known working transponder in the track section to be setup. If no transponder is detected then the direction of the primary conductor, or alternatively the leads of the current transformer secondary, are swapped. With this reversal of current detector direction, transponder detection should occur. Now the reference current direction has been fixed relative to the phase of the track voltage Vs, seen via the synchronizing link 42, at the transponder pulse time window.

It is possible to have reference current reversing due to the use of autoreverse in the booster or devices feeding the current detector. The detection algorithm must then find and account for the change of reference current direction, for the duration that autoreversing occurs. By comparing the present phase of track voltage Vs, at the fixed transponder pulse time window, to the track voltage phase or polarity setup at installation time, it is possible to detect when the track voltage Vs has been reversed. The detector logic then can swap its present reference current direction to allow it to correctly discriminate echoes. Post detection filtering should still be employed to ensure that noise induced detections are rejected.

The detection of the just the reference load current and its direction may be employed to also perform track occupancy detection as well as transponder detection using the same electronics. If current detector sensitivity and conditioning amplifier gains are suitably chosen, then it is possible to perform occupancy detection that detects constant occupancy current loads on the track. Note that it is useful to have the gain and the frequency response of the conditioning amplifier, 5, and the decision threshold of the decision threshold logic, 7, able to be modified under command of the decoding logic, 9. In particular if the low frequency response of the conditioning amplifier is extended to a lower frequency during the interval that occupancy detection is performed, then improved occupancy detection is possible because more of the lower frequency signal component created by a steady occupancy current draw is available for detection. In contrast, during the detection of transponder current, Ia, it is important to raise the low frequency response of the amplifier. This minimizes the duty-cycle or pulse distortion that is possible when the reference load current changes and its lower frequency components are amplified and add a slight slope to the baseline voltage of the conditioning amplifier output, Va.

If the detector needs to work on a layout run on pure DC track control voltages that have no track power edge transitions that cause current pulses in attached loads, then it is possible to add an external DC search current pulse generator, 43, that enables the occupancy detection to work. In this case the DC search pulse generator, 43, produces low-duty cycle voltage pulses, that do not affect layout DC operations, and that are also synchronized by a logic connection, 42 to the decoding logic. If there is a current load, I1, that completes the track circuit, the chosen value of search current or voltage pulses create a detectable current superimposed on the DC track current that is processed as described earlier to provide occupancy detection.

An alternative allowing reliable and sensitive DC track occupancy detection without the need for search pulse generator, 43, is to provide an additional universal track occupancy sensor explained later in this disclosure.

For simplicity, the conditioning amplifier, 6, is shown as a single stage inverting gain implementation in FIG. 2. It may be implemented with multiple cascaded amplifier stages which are designed to provide signal conditioning such that the output voltage, Va, resembles the waveform shown in FIG. 2 when the circuitry is connected in the manner shown in FIG. 1. The resistor 33 and capacitor 34 are employed to set the low frequency limit for the amplifier. Resistor 36 in combination with 33 sets the mid-frequency gain for the amplifier and the capacitor 35 is employed to set the high frequency cutoff of the amplifier. A current sensor implemented as a current transformer needs a burden resistance to control the impedance reflected back to the primary conductor. Additionally a secondary tuning capacitor may be used to tune the transformer. These components are specific to a sensor implementation and are not shown in FIG. 1 explicitly. The back to back signal diodes, 37 and 38, allow the amplifier to limit its voltage swings when large current pulses are seen, avoiding the possibility of the amplifier entering saturation which will destroy pulse amplification fidelity. By employing this well known non-linear gain technique, low voltage levels corresponding to the small transponder current pulses can have maximum amplification for good detection sensitivity. Other types of non-linear and amplification techniques may be employed to provide the needed conditioning amplifier functionality of item 6, and these would follow the spirit of this invention. In particular it is possible to capture the output of a current sensor and convert it directly to digital data with a fast and high-resolution analog to digital converter. A person skilled in the art of design and implementation of digital processing algorithms may then mimic the action of the conditioning amplifier and also the decision logic embodied in the decision threshold logic of item 7. In either case; of discrete implementation of items 6 and 7 or a digital version of these functions or a hybrid mixture of the two approaches, the decoding logic is typically performed by an algorithm based decoding state machine in element 9. This may be either software executing in a suitable processor or a logic gate implementation of a state machine.

The comparator initialization link, 8, (used for a binary data decision implementation) is not explicitly needed in the analog to digital converter and software algorithm approach, since the analog to digital converter data is has non-binary or multiple data values, including polarity. It is then possible for the software algorithm to directly test the digital data values of the polarity pulse pairs to determine the reference load current direction for any track voltage cycle.

The track voltage command decoding algorithms that may be used in item 9 are not presented here since they are widely known public domain techniques, and depend on the which of the many possible methods is chosen to encode commands and address information to the track. The success of this invention relies on the interpretation of the fundamental meaning of the track current sensor information and not the track datacoding format used. This method of discriminating echoes when using low current feedback pulses may be adapted to all currently known track data encoding methods by those with suitable engineering skills.

An interesting usage is the employment of this transponding on layouts controlled by low frequency AC voltage waveforms. In this case the AC power polarity reversals may be used to initiate the transponder time windows. If there is no explicit encoding of the track voltage waveform to determine an encoded address, then the transponder can automatically revert to the transponder encoding of its address by calculating a unique ID_ACK time window based solely upon its unique address, and then produce an ID_ACK at this unique time window. This alternate timed method of transponder implementation is useful when it is not possible to determine a unique ID_ACK window by decoding the track waveform for a unique address, and hence interrogation. The complementary transponder detector uses a matching logic to then scan for ID_ACK pulses in each of the possibly defined encoded time windows that the transponder may calculate.

If a transponder device is placed on a pure DC powered track section, it may automatically revert to an entirely different transponder encoding method, appropriate to method employed for track control that it is able to detect. In the DC power case the transponder now generates a series of ACK pulses that encode its unique ID or address in a predefined binary or digitally timed manner. To ensure detection of a multiplicity of transponders in a single DC powered track section, the duration of the unique identifier bursts is kept as short as practical, and the bursts are then repeated in a regular manner but with an intentional time randomness, to allow the possibility of occasional overlaps and collisions. The bursts are encoded in a manner that allows for the detection of the overlap of bursts from different transponders, so that the information may be rejected as possibly corrupted. By keeping a low duty-cycle of burst duration to repetition time, and randomizing each transmission about this mean repetition transmit time, there is a good probability of detection when multiple transponders are present. An example of an encoded burst of about one millisecond, and a repetition time of one hundred milliseconds average, with ajitter randomly created in multiples of one millisecond is practical. If the DC power used is the well known pulsed-power or timed bursts of unipolar current method, it is also possible to then phase lock and encode transponder ID_ACK windows as for the method used for AC power, using the pulse power transitions for timing.

Figure 4:
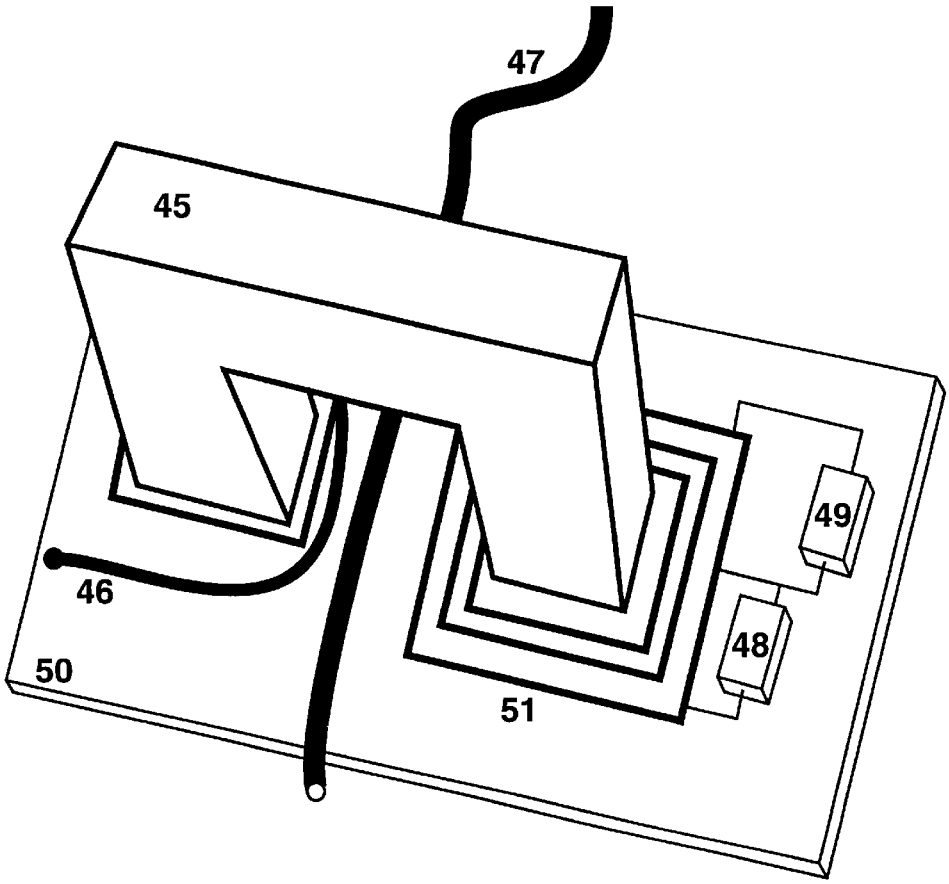
FIG. 4 is a drawing of an improved method for constructing high frequency detection magnetic components.

Referring to FIG. 4, a current sensor may be constructed for model railroad current detection with novel planar techniques that allow high quality and low cost magnetic current sensors to be manufactured. This method uses an insulating substrate, 50, that has the search coil or secondary winding of the current transformer, 51, for the current sensor imprinted upon it by any of the standard methods use to create conductive traces on an insulating substrate. These may include, but are not limited to, printed circuit board fabrication processes, printing or stenciling of a metallic material such as paste or inks, or deposition and etching or selective mechanical removal of a metallic layer. Although the primary current carrying conductor operates at a much higher current level than the secondary or search coil, it may also be simultaneously fabricated using this method as long as the conductor pattern is designed to permit a safe current density for the materials used. Typically the primary conductor is an order of magnitude or more wider than the secondary coil conductors.

One or more apertures, 44, can be created through the center of this search coil which allow the introduction of suitable magnetic components, 45, that create a magnetic flux circuit linking the secondary coil and the primary current carrying conductor, 46. The primary current conductor is typically a single pass of a track current carrying conductor through the magnetic circuit shared with the secondary coil to form a current transformer. This primary current conductor, 46, may also be fabricated on the substrate in the same manner as the secondary coil, or may alternatively be threaded through the magnetic circuit, 45, as a separate wire, 47, for a simpler and smaller planar unit. The planar construction of the secondary or search coil, 51, allows a sensor structure that is compact, easy to handle and automate in manufacturing, yields stable manufacturing tolerances, and has minimum inter-winding stray capacitance that can limit the required high frequency response.

Most magnetic materials need air gaps to ensure they do not magnetically saturate at high currents, which leads to a drastic loss of magnetic coupling and output signal. The air gaps are chosen by a compromise between current sensitivity that is enhanced with smaller gaps and saturation current capacity that increases with larger air gaps. Those skilled at magnetic circuit design may determine the correct magnetic components and air gaps when detector characteristics are chosen. An interesting possibility is that when a thin substrate is employed it is possible to avoid cutting apertures for the magnetic components. It is then possible to simply place the magnetic components on either side of the substrate to create a suitable magnetic circuit, using the substrate thickness to establish the air gap geometry.

It is useful to stack up and interconnect multiple search or secondary coiling to increase the number of winding turns in the final secondary or search coil. This increases current transformer sensitivity. It is possible to arrange the electrical connection of the stacked coils to be completed during the assembly process by the inclusion of appropriately matching and aligned surface mount pads or through-hole leads. These then connect by the introduction of solder, solder paste, conductive adhesive or other conductive connection method used during the assembly process.

The substrate may be configured so it is possible to attach to it the required current transformer burden impedance, 48, for simplicity of construction. Other components, 49, used to create a resonant tank circuit with the secondary circuit, or any other detector components may also be attached to the substrate used to create the search coil and current transformer. The complete detector electronic circuitry may be designed to share the same substrate as the current transformers.

In this case it is useful to use a multi-file and symmetrical arrangement of quad stripline conductors carrying the load currents from the off-board connectors to the primary current turns of the current transformers. This configuration is designed using standard EMC design and geometry techniques to null the nearby radiated magnetic fields to unrelated sensors in close proximity and significantly cuts the mutual coupling and interference between sensors.

An imprinted shorted turn perimeter conductor is easily added around the outside of the magnetic circuit of a magnetic sensor fabricated on a planar substrate. This is used to divert stray external flux, that is not wholly contained within the shorted turn, from penetrating the substrate and linking into the sensor's magnetic path. This lowers noise pickup from external sources.

If the planar coil is used as a component in a separate magnetic assembly for transponder current sensing, then it is useful to surround the outside of the created current sensor with a conductive foil or material that acts as a shorted turn and that will exclude the pickup of stray flux from conductors that do not pass through the magnetic path of the assembly.

With this planar fabrication method it is possible to add a third or tertiary conductor to the magnetic sensor that can be used to inject a calibration current to confirm sensor operation. Manipulation of the timing of this calibration current may also be used to effectively execute the same setting and resetting of the decision threshold logic that the connection 8 performs. A single tertiary calibration conductor can be serially connected through a multiplicity of independent planar sensors on the same substrate and perform the same function on all sensors.

The basic usage of a transponder acknowledgement pulse is to simply identify any addressed devices that are within a single transponder detection track section.

A useful extension is readback of internal device information prompted by a specific readback command addressed to that device. This requirement is suggested in the, currently undefined, advanced feedback of configuration variables in the National Model Railroad public domain standards for Digital Command Control, DCC. It is defined as an extension of the single confirmation pulse available in Service Mode programming readback defined by the NMRA Recommended Practice RP-9.2.3.

Additional and novel new concepts are also possible

Current practice is that transponder ACK replies are related with, and are timed to follow explicitly encoded unique addresses or interrogations directed to a specific transponder.

A new concept is to reserve defined time periods of possible ACK responses, exclusive of the ID_ACK time, and dedicate these possible ACK response windows to encode information from sources for example items 72 and 73, that are not related to the address that the previous track command had intended to interrogate. This is a powerful extension, since we can pre-assign these new external or EXT_ACK possibilities to any type of binary information, from items 72 and 73, way may wish to conduct into the layout control system using the transponder detector infrastructure. Each of the reserved EXT_ACK windows is identified and then assigned, by any method, to a device that may produce an ACK pulse in this window. The meaning of any particular EXT_ACK response may be defined as anything required. If the transponders' timing has low time jitter or the ACK detection criteria are loosened to allow more timing jitter during a selected ACK window, then it is possible to detect multiple simultaneous and synchronized ACK pulses. This means that it also possible to assign selected EXT_ACK windows so multiple devices may respond and that we detect any one of many devices responding, even though we may not be able to identify the source of the sender. This is useful for example, to convey an alarm condition.

A transponder on the tracks, with a uniquely assigned EXT_ACK window, may be configured to send an allowed EXT_ACK in response to a signal generated by a particular angle of an associated track wheel or timing cam. This allows an external layout sound generator that is connected to receive information from transponder detectors, to create synchronized sounds for the layout. Of particular benefit is that this allows layout surround sound to be generated that is appropriate for the transponder equipped device, for example an articulated steam engine sound as distinct from a narrow-gauge shay steam engine sound. Since the transponders also provide layout location, it is not only possible to provide prototypically accurate synchronized steam chuff and sounds, but now each individual sound may be blended into multiple loudspeakers with amplitude and time delay controlled to project a perceived acoustic image of its actual location on the railroad layout. Note that most control systems send many commands per second and each of the commands sent may elicit an EXT_ACK response, so the response time of this EXT_ACK method is not limited by the rate commands are sent to any single address.

It is also possible to allow the defined EXT_ACK windows to occur conditionally only in response to a particular condition or situation that all devices can recognize.

The addition or removal of transponder equipped units from the layout may be monitored to alert the control system to faults or other activities, as separate from units that are simply reporting location infonnation.

Here it is useful to allocate an EXT_ACK type of response window to a new state called a NACK. This NACK (not acknowledgement) is generated by a transponder that has not been addressed in a sensible period by the system, since it was placed on the powered tracks. This alerts the system to then initiate a scan for the new unit with an address that is currently not in use. Upon being addressed by a command from the system, a transponder in the NACK responding state provides a normal ID_ACK response and stops sending the NACK alarm. The system can then detect the new address and its location, even though it is not required to assert control of the unit at that time. Multiple devices in the NACK state may be detected at the same time.

To conserve the limited resource of available EXT_ACK windows, it is possible to qualify the EXT_ACK window that defines a NACK response to occur only after a particular condition. In this instance it is sensible to use the occurrence of a null address, that defines a command is "idle" and goes to no address as the condition that allows the NACK condition to be transmitted by the transponder. In this case the system periodically issues this condition, the null or idle command, and then sees if any NACK responses follow that would indicate a scan of possible addresses is needed because a new un-addressed unit has been placed on the layout. It is useful to also define the NACK response to be comprised of the same number of ACK responses as the ID_ACK is, to allow the transponder detectors to have multiplexed sensors and still fully monitor all sensors.

With some command systems the range of addresses is very large, and may be in the many thousands of units, and places a burden of a possibly very long scan time to search all unused addresses and find a unit reporting the NACK alarm State. A further expansion to solve this is to provide an additional EXT_ACK alarm feature for fractional address acknowledgement or ADR_ACK. This is ADR_ACK designed to be issued when defined sub-sets of available address bits match those same bits of the last issued command address. This allows the search algorithm to partition the range of addresses to be searched, and then find if a NACK responding device exists in any of the possible address ranges. Once the fraction of addressable ranges with NACK responding units has been initially searched, then the system is only required to search the addresses in the identified address ranges. This can speed up the search algorithm from that of an exhaustive search by a factor of ten to fifty times or more, depending on the total address range and how many sub-address groupings are chosen to be searched. As for the associated NACK and ID_ACK, the ADR_ACK may be expanded to a matching number of ACK pulses. It is useful for transponder detectors to process the interruption of ID_ACK pulses from units on the layout that it has tracked, to determine if they may have moved to other sections of the layout and are reported by other transponder detection devices. If a transponder appears elsewhere, as reported to the layout control system, then the transponder detector seeing a loss of ACK_ID signal for this device can terminate monitoring of this address. If a alarm period elapses with no detection anywhere else on the layout, then the transponder detector can issue an alarm to the system that a unit has been removed from normal operation the layout and provide a unit address, location and time of signal loss. This is useful for detecting human interventions or derailments. In a networked layout control system the transponder detection devices may implement this removal alarm logic without burdening other control elements in the system. If the transponder detection devices are in a centralized system without autonomous logic allowed then the main system control logic has to perform this alarm state function.

Figure 5:
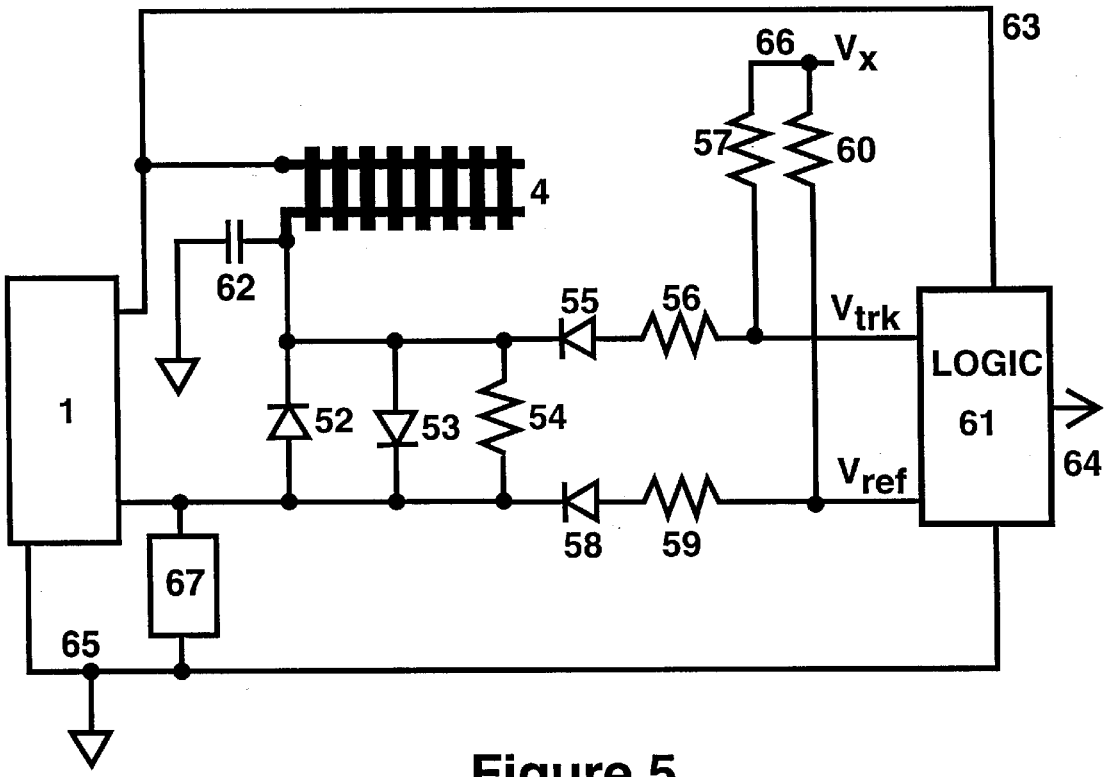
FIG. 5 is a circuit drawing of an improved design for universal block occupancy detection.

FIG. 5 shows the design for a universal track occupancy detector that has useful properties. With direct home wiring from the track power booster, 1, the track voltage Vs is always positive with respect to the system ground reference point, 65. Using the standard back to back current sense diodes, items 52 and 53, means that the detection voltages are developed differentially across the approximate 0.75V diode forward voltage drops while the diodes are changing from almost ground reference to the maximum peak voltage of Vs. This may be up to approximately +22 volts if used with G-gauge model layouts. To detect this small occupancy detection voltage with such a large and often high frequency common mode voltage swing, puts a stringent requirement on the voltage detection devices used. To use most integrated circuit operational amplifiers or comparators, a high supply voltage greater than Vs must be used to ensure that the input voltages do not exceed the allowable device common mode input ranges. Alternatively input attenuators may be employed with precise matching to divide the input voltages. Any attenuator division errors tend to convert the Vs common mode voltage into erroneous detection voltages, since the detection voltage is a fraction of a volt and is typically 25 to 50 times smaller than the track voltages used.

The solution presented by the circuit in FIG. 5 is to perform the detection only when the track voltage, Vs, is at its lowest potential above the ground reference, 65, since the full track current is flowing through the sense diodes 52 and 53. The diodes 55 and 58 are used to block or isolate the sensing of the voltages across the detection diodes 52 and 53 when they are above the detector supply voltage, Vx, item 66. When the detection voltages across diodes 52 and 53 are below the value of Vx, by the amount of the on voltage of the blocking diodes 55 and 58, then the resistor pair 56 and 57 and pair 59 and 60 act as an attenuator biased by the voltage offset of Vx.

The point between resistors 56 and 57 develop Vtrk, a sample of the track detection voltage that represents the track connected end of the current sensing diodes, 52 and 53. The point between resistors 59 and 60 develop Vref, a reference voltage that represents the reference connected end of the current sensing diodes, 52 and 53.

With this design, the ratios of resistor 56 to 57 and 59 to 60 are chosen to create detection voltages with the most advantageous values for detection. If the voltage comparison logic, 61, is performed digitally after the detection voltages Vtrk and Vref have been digitized by an analog to digital converter, then the two attenuators will have the same division ratio. The on voltage of blocking diodes 55 and 58 are closely matched since they are the same type of diodes operating at similar current levels and at the same temperature. In practical operation they do not need to be exactly matched.

If a comparator directly performs the detection comparison of Vtrk and Vref, then the attenuator ratios may be slightly different so as to develop a chosen offset voltage that conveniently becomes the detection voltage decision threshold.

Typically Vx is in the convenient range of +5 to +12 volts DC, and the detector will work comparing Vtrk to Vref even with the track voltage Vs cycling to an extreme peak value of +22 Volts or more. Values of 27 kilo-ohms for resistors 56 and 59, and 47 kilo-ohms for resistors 57 and 60 , and Vx at +5 volts give a attenuation ratio of approximately 63% of Vs with an offset of +2.15 volts. In this case the Vtrk and Vref voltages can swing from +2.15 volts to +5 volts when Vs swings from ground reference to +22V.

The resistor 54 is employed for several reasons. It is used to set the desired detector sensitivity, to create a discharge path to ensure that the diodes 52 and 53 have their internal space charges dissipated rapidly on current flow reversal and to also ensure a short time constant for the voltage transient caused by track voltage excursions charging the feeder and track stray capacitance, 62, to ground. If a value of 1 kilo-ohm is chosen for resistor 54 then with a track voltage Vs of 0 to +12 volts a typical model railroad detection test resistor of 22 kilo-ohms across the detection track will cause a detection voltage of 0.52 volts across the resistor 54.

With matched attenuator ratios of 63% the voltages of Vref and Vtrk will then differ by about 0.328 volts when Vs swings to 0 volts with respect to ground, 65. In this circuit Vtrk will be more positive than Vref by the 0.328 volts stated. These voltages are of sufficient magnitude as to be easily processed without further amplification. If the ratios of the attenuator are modified by worst case deviations of attenuator values of +5% and −5% then it can be shown the detection voltages are only changed by −0.12 volts and +0.098 volts respectively. This is considerably less than the 0.328 volt detection voltage when using a 22 kilo-ohm detection resistance threshold, which indicates that the circuit is not sensitive to component tolerances.

With a 22 kilo-ohm detection load we need not consider the diode currents in 52 and 53, since 0.52 volts across them is below the forward conduction voltage of standard high current diodes used in this application. With low impedance track loads that allow many amperes of load current, the diodes 52 and 53 conduct almost all this current with a typical voltage drop of 1V to 1.5V, depending on the exact diodes chosen and the actual current.

The preferred embodiment uses an analog to digital converter to sample and convert the detection voltages Vtrk and Vref. This circuit design ensures that the input voltage range for these two voltages always remain within the allowable range for standard converters operating from a +5 volt supply. This voltage range also allows the use of standard analog voltage multiplexer or selector devices to be employed to allow a single analog to digital converter to sample and detect a multiplicity of occupancy detection track circuits, each employing a separate instance of the items 52,53,55,58,56,57,59,60 and 54. If a multiplicity of detectors share a common reference connection to the track power booster, 1, then it is possible to use a single instance of items 58,59,60 to develop a Vref for all the current sense diodes connected with anodes of 52 and cathodes of 53 in common to the reference.

The use of an analog to digital converter also allows this circuit to discriminate the transient false detection voltages caused by the charging and discharging of stray capacitance, 62, when no detection loads are present on the track. Upon detecting a voltage transition of Vs to a low level, using either the synchronizing connection 63 or sampling Vref until it goes to a low potential, the converted digital value of Vref is then saved. A transient filter time is then allowed to elapse that is longer than the charging time of the capacitance 62 but less than the time of the low cycle of Vs, during which it is possible to measure Vtrk. After this transientfilter time, the value of Vtrk is then sampled and converted to a digital value. An algorithm may then inspect the two converter output values to decide if Vtrk is sufficiently more positive than Vref to indicate the detection of occupancy, typically more than 0.328 volts for a threshold resistance of 22 kilo-ohms. This allows the rejection of charging transient voltages for up to the duration chosen for the transient filter time. Note that Vref is unaffected by this charging current since is driven directly by the low impedance of the track booster, 1, and does not require to be sampled with any delay after Vs enters its low voltage state. This feature is important on large layouts with extensive wiring that employ track control voltages with fast changing voltage swings.

Using a digital method to discriminate between values of Vtrk and Vref also allows several other possibilities. It is possible to detect when Vs is off because the booster, 1, has been disconnected due to a fault or has been powered off. In this case, the voltage of Vtrk and Vref will both tend to the voltage Vx, in this example, +5 volts. The algorithm may then infer that the track power has been disconnected and hence detection on the track is not possible and hence indeterminate. This does not imply that the track is unoccupied. In this case, the comparison logic, 61, can conduct information to the rest of the layout control system via output link 64 that accurately and completely encodes the state of any occupancy track sections that are being monitored.

Note that it is better to measure Vtrk and Vref separately rather than simply employ a differential amplifier to extract solely the difference voltage, since additional information may be extracted by examining these differential detector voltages independently. This is true whether a digital comparison is employed, as in the preferred embodiment, or a voltage comparator is used for detection. Note that the explicit measurement of Vref in this circuit compensates if the lowest potential of Vs does not go to ground potential, 65, due to current loads flowing in the output impedance of the booster. Large load currents switched on the track between the sampling of Vref and the delayed sampling of Vtrk may lead to spurious voltages that mimic detection.

Accordingly it is preferred that the final detection decision is made and communicated via the output link 64, after filtering or averaging of a multiplicity of detection events. It is also possible to employ two separate analog to digital converters to sample Vtrk and Vref simultaneously after the transient filter time has elapsed, which will avoid the ambiguity of sampling at different times. In any case it is best to sample Vref as close as possible to the time that Vtrk is sampled.

If a simple voltage comparator is used for detection, then the output of the comparator is only sampled and a detection decision made after the transient filter time, to allow the rejection of the charging current of capacitance 62.

The actual values employed in this circuit may be modified for the convenience of the designer from those presented here and the resulting circuit will still be within the spirit of this invention.

If a short circuiting link, 67, is now connected as shown in FIG. 5, then the booster track drive for rail A will then be connected to system ground, 65. The installation of this single link, 67, will convert the detector from direct home wiring to the common rail wiring method. This allows the simplicity of manufacturing a single occupancy detector that is usable on any layout.

This arrangement is now similar, but not identical, to a Twin-T detector. The Vref input is now connected to ground, 65. The voltage across diodes 52 and 53 are now constrained to be limited to the forward biased diode voltages of diodes 52 and 53 above or below ground potential, 65. This ensures that with a track voltage of e.g. −1.0 volts (typical for diodes with large current flows) that Vtrk will be no lower than, 2.15V+(0.63×−1.0V), which at +1.52 volts is safely within the input range of the analog to digital converter, even with this negative voltage range. The detection voltage is still calculated as (Vtrk−Vref) as for the direct home case. The unchanging nature of Vtrk, even when the synchronizing link 63 indicates Vs is changing, allows the comparison logic, 61, to automatically decide that this particular detection track has been configured to the common rail method with the addition of link 67. The logic may then interpret and report on the detection voltages via the output link 64, accordingly. To detect when a common rail booster driving the occupancy tracks and detectors has been turned off, it is useful to use one of the multiplicity of detectors with a fixed detection resistor installed, in lieu of a track section, to detect when the track power is off. In this case the chosen occupancy detector with a fixed detection resistor will report occupied when the booster track power is applied, and the rest of the control system is configured to understand the meaning of this report as being an indication of the state of applied power.

With the link 67 installed it is also possible to detect DC block occupancy when simple DC track power control is being used. It is possible to accurately determine when occupancy is detected with power applied, but other components must be added to decide when there is no track power present to allow track detection.

With occupancy detection on DC controlled layouts it is a common practice to employ an AC voltage bias connected through a current limiter to allow detection when the DC control voltage is low or the block has been disconnected with rolling stock still present. This method is may also be employed with this detector design.

Alternately the shorting link 67 may be converted to a current sensor made with the three components in the same manner as 52, 53 and 54. A resistor of the same value as 54 is then connected from the anode end of a 52 current detector to the other lead from the DC power supply. In this way the Vref and Vtrk voltages will now have a detectable extra voltage when the DC power is applied which allows the detector to know when detection is valid. Prototype railroad practices dictate that the most restrictive condition must be assumed when a plant or device fails. Thus it is best that a block indicate occupied if detection is not valid.

Note that the comparison logic, 61, can automatically identify what form of detection it is performing, common rail or direct home, for each sensor by inspecting the voltage ranges that it sees for Vtrk and Vref of each sensor it monitors. Additionally it can also automatically recognize the track voltage encoding or control method and adjust detection parameters accordingly.

What is claimed:

1. A method of forming an apparatus for detecting track occupancy on a model railroad layout (4), comprising the steps of:

providing a two terminal current detection arrangement (52,53), an attenuator arrangement (56,57,59,60), a comparison logic device (61), short circuit link (67), and a ground connection (65);

connecting first and second terminals of said two terminal current detection arrangement to said attenuator arrangement to produce $V_{trk}$ and $V_{ref}$ voltages;

connecting said $V_{trk}$ and $V_{ref}$ voltages to said comparison logic device (61) for processing;

positioning said short circuit link for selective connecting and disconnecting said second terminal to said ground connection so to configure said apparatus to selectively operate in a common rail wiring operating mode, in which said short circuit link electrically connects said second terminal to said ground connection, and in a direct home wiring operating mode, in which said short circuit link disconnects said second terminal from said ground connection.

2. The method of claim 1, wherein said apparatus includes a stray feeder capacitance (62) connected to operate with said two terminal current detection arrangement, and further including the step of configuring said comparison logic device so as to be capable of processing said $V_{trk}$ and $V_{ref}$ voltages at a predetermined transient filtering time, with said short circuit link connecting said second terminal to said ground connection.

3. The method of claim 1, wherein said apparatus includes a stray feeder capacitance (62) connected to operate with said two terminal current detection arrangement, and further including the step of configuring said comparison logic device so as to be capable of processing said $V_{trk}$ and $V_{ref}$ voltages at a predetermined transient filtering time, with said short circuit link disconnecting said second terminal from said ground connection.

4. The method of claim 1, further including the step of configuring said comparison logic device to analyze said $V_{ref}$ voltage to determine an energization state of a booster (1) adapted for powering said railroad layout, with said short circuit link disconnecting said second terminal from said ground connection.

5. The method of claim 1, further including the steps of configuring said comparison logic device to analyze said $V_{trk}$ and $V_{ref}$ voltages so as to detect a connection status of said short circuit link and to determine whether said direct home wiring operating mode is in effect.

6. The method of claim 1, further including the steps of providing blocking diodes (55,58) connected between said antenuator arrangement and said two terminal current detection arrangement for regulating a proper level of said $V_{trk}$ and $V_{ref}$ voltages applied to said comparison logic device.

7. The method of claim 6, wherein said apparatus includes a stray feeder capacitance (62) connected to operate with said two terminal current detection arrangement, and further including the step of configuring said comparison logic device so as to be capable of processing said $V_{trk}$ and $V_{ref}$ voltages at a predetermined transient filtering time, regardless of a selected position of said short circuit link.

8. The method of claim 6, further including the steps of configuring said comparison logic device to analyze said $V_{ref}$ voltage to determine an energization state of a booster (1) adapted for powering said railroad layout, with said short circuit link disconnecting said second terminal from said ground connection.

* * * * *